US011148317B2

(12) United States Patent
Kalwa

(10) Patent No.: US 11,148,317 B2
(45) Date of Patent: Oct. 19, 2021

(54) WOOD MATERIAL BOARD WITH REDUCED EMISSION OF VOLATILE ORGANIC COMPOUNDS (VOCS) AND METHOD FOR THE PRODUCTION THEREOF

(71) Applicant: SWISS KRONO Tec AG, Lucerne (CH)

(72) Inventor: Norbert Kalwa, Horn-Bad Meinberg (DE)

(73) Assignee: SWISS KRONO Tec AG, Lucerne (CH)

( * ) Notice: Subject to any disclaimer, the term of this patent is extended or adjusted under 35 U.S.C. 154(b) by 155 days.

(21) Appl. No.: 16/506,441

(22) Filed: Jul. 9, 2019

(65) Prior Publication Data

US 2019/0329445 A1 Oct. 31, 2019

Related U.S. Application Data

(63) Continuation of application No. 15/778,882, filed as application No. PCT/EP2016/076568 on Nov. 3, 2016, now Pat. No. 10,399,245.

(30) Foreign Application Priority Data

Dec. 7, 2015 (EP) ..... 15198210

(51) Int. Cl.
*B27N 1/00* (2006.01)
*B27K 5/00* (2006.01)
(Continued)

(52) U.S. Cl.
CPC ..... *B27N 1/003* (2013.01); *B27K 5/001* (2013.01); *B27K 5/0085* (2013.01); *B27N 1/00* (2013.01);
(Continued)

(58) Field of Classification Search
None
See application file for complete search history.

(56) References Cited

U.S. PATENT DOCUMENTS 4,553,978 A 11/1985 Yvan
5,641,819 A 6/1997 Campbell
(Continued)

FOREIGN PATENT DOCUMENTS

CN 104690803 A 6/2015
DE 102004010796 A1 * 9/2005 ..... B27N 1/00
(Continued)

OTHER PUBLICATIONS

Process to manufacture medium density fiberboard, Sep. 22, 2005, machine translation of DE 102004010796 (Year: 2005).*
(Continued)

*Primary Examiner* — Chinessa T. Golden
(74) *Attorney, Agent, or Firm* — The Webb Law Firm

(57) ABSTRACT

A method for producing wood material boards with reduced emission of volatile organic compounds (VOCs), including: a) producing woodchips from suitable timbers; b) heat-treating at least one portion of the woodchips at a temperature between 150° C. and 300° C. for a period of 1 to 5 hours; c) crushing the wood chips that are not heat-treated and at least one portion of the heat-treated woodchips by machining in order to obtain wood shavings or by solubilizing in order to obtain wood fibers; d) gluing the wood shavings or wood fibers with at least one binding agent; e) applying the glued wood shavings onto a transport belt while forming a multi-layered shavings cake or applying the glued wood fibers onto a transport belt while forming a single-layer fiber cake; and f) compressing the shavings cake or the fiber cake to form a wood material board.

17 Claims, 2 Drawing Sheets

(51) Int. Cl.
*B27N 3/18* (2006.01)
*B27N 3/02* (2006.01)

(52) U.S. Cl.
CPC ..... *B27N 3/02* (2013.01); *B27N 3/18* (2013.01); *B27K 2240/10* (2013.01)

(56) References Cited

U.S. PATENT DOCUMENTS

| | | | | |
|---|---|---|---|---|
| 6,376,582 | B1 | 4/2002 | Iwata et al. | |
| 2008/0263890 | A1 | 10/2008 | Picard | |
| 2009/0130474 | A1 | 5/2009 | Ishimoto et al. | |
| 2012/0108707 | A1 | 5/2012 | Gunschera et al. | |
| 2012/0202041 | A1* | 8/2012 | Kasmayr ..... | B32B 5/30 428/313.5 |
| 2013/0209822 | A1 | 8/2013 | Maes et al. | |
| 2013/0331484 | A1 | 12/2013 | Braum et al. | |
| 2015/0217477 | A1 | 8/2015 | Nicholson et al. | |
| 2015/0376530 | A1 | 12/2015 | Brusletto et al. | |

FOREIGN PATENT DOCUMENTS

| | | | |
|---|---|---|---|
| DE | 102004010796 | A1 | 9/2005 |
| EP | 0639434 | B2 | 1/2004 |
| EP | 2447332 | B1 | 5/2012 |
| EP | 2567798 | A1 | 3/2013 |
| EP | 2765178 | A1 | 8/2014 |
| EP | 2889112 | A1 | 7/2015 |
| EP | 3170635 | A1 | 5/2017 |
| FR | 2989016 | A1 | 10/2013 |
| JP | 2000280208 | A | 10/2000 |
| JP | 2013180460 | A | 9/2013 |
| WO | 2010136106 | A1 | 12/2010 |
| WO | 2012168563 | A2 | 12/2012 |
| WO | 2017084884 | A1 | 5/2017 |

OTHER PUBLICATIONS

Ito et al., "Improved decay resistance of wood chip with superheated steam treatment and performance evaluation thereof as construction material", 1967, 4 pages.

Miertzsch et al., "Zum Mechanismus der Bildung von flüchtigen Säuren bei der Verleimung mit alkalisch härtenden Phenolformaldehydharzen", Holz-Zentralblatt ,1990, pp. 1684-1685, vol. 116. English-language Abstract.

Pelaez-Samaniego et al., "A review of wood thermal pretreatments to improve wood composite properties", Wood Science and Technology, 2013, pp. 1285-1319, vol. 47.

Schafer et al., "On the formaldehyde release of wood", Holz als Roh- und Werkstoff, 2000, pp. 259-264, vol. 58.

Unsal et al., "Properties of Wood and Wood Based Materials Subjected to Thermal Treatments Under Various Conditions", ICWSE, 2009, pp. 81-94.

Garcia et al., "Dimensional stability of MDF panels produced from heat-treated fibres", Holzforschung, 2006, pp. 278-284, vol. 60.

Ito et al., "Durability-enhancement of wood base chips by heat-steam treatment and performance assessment of the same chips as construction materials" (in Japanese), 2011, Brief progress report of research grant project by Emachu Mokuzai & Emachu Gohan, Research Grant Project of Emachu Moakuzai & Emachu Gohan, Japan, 5 pages. (Relevant for reasons stated in the Office Action).

* cited by examiner

WOOD MATERIAL BOARD WITH REDUCED EMISSION OF VOLATILE ORGANIC COMPOUNDS (VOCS) AND METHOD FOR THE PRODUCTION THEREOF

CROSS-REFERENCE TO RELATED APPLICATIONS

This application is a continuation of U.S. patent application Ser. No. 15/778,882, filed May 24, 2018, which is the United States national phase of International Application No. PCT/EP2016/076568 filed Nov. 3, 2016, and claims priority to European Patent Application No. 15198210.5 filed Dec. 7, 2015, the disclosures of which are hereby incorporated in their entirety by reference.

BACKGROUND OF THE INVENTION

Field of the Invention

The present invention relates to a process for producing woodbase panels, more particularly wood chipboard panels or wood fiberboard panels, to wood chipboard panels produced by the process, to wood fiberboard panels produced by the process, to use thereof, and to the use of wood shavings and wood fibers produced from heat-treated wood chips.

Description of Related Art

Panels made of woodbase materials, such as wood chipboard panels or wood fiberboard panels, with wood fiberboard panels presently always referring to medium- or high-density wood fiberboard (MDF/HDF) panels, form the basis of many articles in everyday life, such as of furniture or of coverings for wall, floor or ceiling, for example. As well as a number of technological parameters relating to the strength of the boards and the mechanical load, the emissions from the products are an increasingly important criterion of quality.

The emissions, especially of volatile organic compounds (VOCs), customarily represent only a minor problem in the context of a wood chipboard or fiberboard panel, since in numerous products the surface is enhanced with decorative coatings. There are also applications, however, in which wood chipboard and fiberboard panels are used uncoated on a relatively large scale (for example, as tongue-and-groove boards, in interior outfitting, etc.). Lightweight and superlightweight wood fiberboard panels are also often used without a coating. A critical aspect here is that, with regard to emissions, it is common to use the so-called AgBB scheme as a reference, by determining emissions on the assumption of a space loading of 1 $m^2/m^3$ and a defined air exchange (0.5/h). By wall and ceiling paneling systems, floor coverings, and furniture made from MDF/HDF wood fiberboard panels, however, these space loadings may be significantly exceeded. Additionally, the air exchange of 0.5/h is often significantly above the actual rate in modern low-energy homes. In combination, these factors may result in higher space concentrations of wood constituents.

Over the course of the production of woodbase panels, and particularly due to the operation of producing the wood shavings and wood fibers, a large number of volatile organic compounds are formed and/or released. The volatile organic compounds, also called VOCs, include volatile organic substances which readily evaporate or are present in gas form even at relatively low temperatures, such as room temperature, for example.

Either the volatile organic compounds VOCs are already present in the wood material, and are emitted from it in the course of processing, or, according to the present state of knowledge, they are formed by the breakdown of unsaturated fatty acids, which in turn are decomposition products of the wood. Typical conversion products which occur during work on the materials are, for example, higher aldehydes or else organic acids. Organic acids are obtained in particular as dissociation products of the wood constituents cellulose, hemicelluloses, and lignin, with formation preferentially of alkanoic acids, such as acetic acid, propionic acid, hexanoic acid, or aromatic acids. Aldehydes are formed during hydrolytic processing from the basic building blocks of cellulose or hemicellulose. For example, the aldehyde furfural is formed from mono- and disaccharides of cellulose and/or hemicellulose, whereas aromatic aldehydes may be released during the partial hydrolytic digestion of lignin. Other aldehydes released include the higher aldehydes hexanal, pentanal or octanal.

A variety of approaches have been described in the past for solving the problem of VOC emission. One possibility is to mix wood fibers with other natural fibers, such as wool or hemp flax, for example, that are more favorable in terms of their emissions behavior, in order thereby to obtain an ecological wood fiberboard panel with improved emissions characteristics. A disadvantage in that case, however, are the limited availability and high costs associated with these fibers, since in some cases there are also higher-value applications in existence for the corresponding types of fiber, which suggest a different use.

It is also possible to add alkaline substances to raise the pH in the wood matrix, in order thus to prevent or to reduce the acid-catalyzed reactions that take place within the wood matrix (Roffael, E., et al, Holzzentralblatt 1990, 116: 1684-1685). Further possibilities in the reduction of emissions of volatile organic compound lie in the addition of zeolite (WO 2010/136106), bisulfites or pyrosulfites (US2009/0130 474 A1), as aldehyde scavengers, or else in the addition of polyamines for reduction of organic acids and aldehydes released during the aqueous digestion of wood (EP 2 567 798).

EP 0639434 B2 describes a production process for MDF panels that differs from the conventional processes in the fiber digestion area. Here, a CTMP (chemo-thermo-mechanical pulping) method is used for fiber digestion, in order to reduce the emissions of volatile organic compounds in the final wood fiberboard. This was done by supplying $Na_2SO_3$ or NaOH as a chemical component. That process, however, has so far not become established on the market.

Accordingly, there continues to be a very great demand for low-emissions woodbase panels and also for extremely simple and reliable production processes.

A technical problem addressed by the present invention is therefore that of providing a process for producing woodbase panels, more particularly wood chipboard or wood fiberboard panels, that allows these woodbase panels to be produced with significantly improved VOC emission levels. This process ought to take place without substantial alterations to the conventional manufacturing operation, and ought not to lead to cost increases. Also, the production itself should not generate any higher emissions or cause more severe pollution of the process waters customarily arising. Moreover, the resulting products ought to be able to be processed without problems in the downstream value chain.

SUMMARY OF THE INVENTION

This problem is solved in accordance with the invention by means of a process for producing woodbase panels, more particularly wood chipboard panels and wood fiberboard panels, and by woodbase panels produced by this process.

Provided accordingly is a process for producing woodbase panels, more particularly wood chipboard panels and wood fiberboard panels, with reduced emission of volatile organic compounds (VOCs), comprising the steps of:

a) producing wood chips from suitable lumbers,
b) heat-treating at least a part of the wood chips at a temperature between 150° C. and 300° C. over a period of 1 h to 5 h;
c) comminuting the non-heat-treated wood chips and at least a part of the heat-treated wood chips by shaving to give wood shavings or by digesting to give wood fibers;
d) resinating the wood shavings or wood fibers with at least one binder;
e) applying the resinated wood shavings to a conveyor belt, to form a multilayer shaving cake, or applying the resinated wood fibers to a conveyor belt, to form a single-layer fiber cake; and
f) compressing the shaving cake or the fiber cake to form a woodbase panel.

The present process allows the production of woodbase panels such as wood chipboard panels and wood fiberboard panels using heat-treated wood, more particularly heat-treated wood chips, which are introduced additionally or alternatively to untreated, non-heat-treated wood chips, into a known production operation.

A woodbase panel produced by the process of the invention, particularly in the form of a chipboard or fiberboard panel with a typical panel density of 400 to 1200 kg/m$^3$, comprising wood shavings or wood fibers produced from heat-treated wood chips, features reduced emission of volatile organic compounds, more particularly of higher aldehydes and also of organic acids.

The provision of the present process produces further advantages. Hence it is possible to produce woodbase panels, such as chipboard and fiberboard panels, easily, without the customary operating chain being substantially affected. Moreover, the emission of volatile compounds into the air, in the course of the operation of producing the woodbase panels, and the pollution of the process waters are reduced.

The presently employed heat treatment of the wood chips takes place preferably in a saturated steam atmosphere, in particular under an elevated pressure, preferably above 5 bar.

The present heat treatment may be understood either as a conventional torrefaction or else, at least with regard to the pressure conditions, as a modification of the conventional torrefaction. Torrefaction is a thermal treatment process in which the material for torrefaction is heated in an oxygen-free gas atmosphere, typically at atmospheric pressure. The treatment of biomass without ingress of air results in pyrolytic decomposition and drying. The process is carried out at temperatures of 250 to 300° C., which are relatively low for a pyrolysis. The objective, similarly to that in the case of coking, is to raise the energy density per unit mass and per unit volume and hence to raise the calorific value of the raw material; to increase transportability; or to reduce the cost and complexity of any subsequent grinding-down of biomass.

In the present process, the step of heat-treating the wood chips may be provided in a variety of ways.

For instance, according to one embodiment, it is possible to integrate the step of heat-treating the wood chips into the operation of producing the woodbase panels, such as chipboard and fiberboard panels; in other words, the heat-treatment step is incorporated into the overall operation or operational line and takes place on-line.

In an alternative embodiment, the step of heat-treating the wood chips may be carried out separately from the operation of producing the woodbase panels, such as chipboard and fiberboard panels. Accordingly, in this variant embodiment of the present process, the heat-treatment step takes place outside the overall operation or operational line. The wood chips are in this case taken out of the production operation and introduced into the heat-treatment apparatus (e.g., heat-treatment reactor). The heat-treated wood chips subsequently, where appropriate after having undergone interim storage, can be reintroduced into the conventional production operation. This enables high flexibility in the production process.

The wood chips presently used may have a length between 10 to 100 mm, preferably 20 to 90 mm, especially preferably 30 to 80 mm; a width between 5 to 70 mm, preferably 10 to 50 mm, especially preferably 15 to 20 mm; and a thickness between 1 and 30 mm, preferably between 2 and 25 mm, especially preferably between 3 and 20 mm.

In a further embodiment of the present process, the wood chips are heat-treated at temperatures between 200° C. and 280° C., especially preferably between 220° C. and 260° C.

As observed above, the operation of heat-treating the wood chips may be over a period between 1 and 5 h, preferably between 2 and 3 h, with the duration of the operation varying in dependence on the quantity and nature of the starting material used. The heat-treatment operation is preferably ended at a loss of mass of the wood chips of 10% to 30%, preferably 15% to 20%.

As already mentioned above, in one variant embodiment of the present process, the wood chips are heat-treated by heating in an oxygen-depleted or oxygen-free atmosphere, more particularly in a saturated steam atmosphere. This may take place under atmospheric pressure. In the event that saturated steam is used, the heat-treatment operation runs preferably at temperatures between 160° C. and 220° C. and at pressures of 6 bar to 16 bar.

It is likewise preferred if at least a part of the wood chips with a moisture content of 20-50 wt % are heat-treated; in this case, in other words, there is no prior drying of the wood chips, the wood chips instead being supplied to the heat-treatment apparatus without further pretreatment after the shaving.

The heat-treatment reactor presently employed may take the form of a batch plant or of a continuously operated plant.

The pyrolysis gases released during the heat-treatment operation, essentially from hemicelluloses and other compounds of low molecular mass, are utilized for the generation of operational energy. The amount of gas mixture formed in this case is sufficient as a gaseous fuel to allow the operation to be operated with self-sufficiency in terms of energy.

The heat-treated wood chips are cooled preferably to room temperature and, where appropriate with interim storage, or directly, are supplied back to the production operation, where appropriate after moistening.

In one variant of the present process, the heat-treated wood chips are cooled and wetted in a water bath, the water being admixed with at least one wetting agent. The wetting agent—a conventional surfactant, for example—facilitates the wetting with water of the hydrophobic surface of the wood chips, this surface having come about as a result of the heat treatment. The amount of wetting agent in this case in the water bath into which the wood chips are transferred is 0.1 to 1.0 wt %. The water wetting has a positive influence on the subsequent operation of shaving or fiberizing. The wetting of the shavings or fibers with binders which comprise water as solvent is also improved as a result. At the outcome of the water wetting operation, the moisture content of the heat-treated chips is adjusted to 5% to 20%, preferably 10% to 15%.

The moisture content of the untreated, non-heat-treated wood chips is likewise adjusted correspondingly. In this step, for example, the wood chips are washed and boiled. The water treatment is desirable to allow the wood chips to be shaved or fiberized, respectively. Without water, moreover, a great quantity of unwanted dust would be formed in the course of the shaving or fiberizing procedure.

This is followed by an operation of flaking the wood chips in a flaking device, or by an operation of fiberizing the wood chips in a refiner; it is likewise possible, additionally, for a wetting agent to be added in order to improve the water wetting of the heat-treated wood or the wood chips, this addition taking place, where appropriate, to wood shavings or to wood fibers during the fiberizing operation.

The wood shavings produced in the flaking operation are subdivided into coarse and fine shaving material, with the larger wood shavings being used preferably in the middle layer of the chipboard, and the smaller wood shavings being used preferably in the outer layers. It is preferred in this case if the wood shavings employed in the middle layer have been produced from heat-treated wood chips, since these typically have a dark coloration.

When the dark-colored shavings are used in the middle layer, therefore, there is no adverse effect on the visual appearance of the panel. Given that the middle layer typically accounts for about ⅔ of a chipboard panel, moreover, the effect on reduced emissions is not negatively impacted.

The wood fibers produced by the flaking operation have a length between 1.5 mm and 20 mm and a thickness between 0.05 mm and 1 mm.

In a further step of the present process, the wood shavings after the flaking operation or the wood fibers after the fiberizing operation are contacted with at least one binder suitable for linking together the wood shavings or wood fibers; this contacting of the wood shavings and wood fibers with the binder may take place in different ways in each case.

For instance, the wood fibers may be contacted with the at least one binder in step d) in a blowline process, in which the binder is sprayed into the stream of wood fibers. In this case it is possible for the binders, which are described later on below, for linking together the wood fibers, to be supplied in the blowline to a wood fiber/steam mixture.

Wood shavings, conversely, are contacted with the binder preferably in a mixing apparatus.

The amount of binder added is dependent on the nature of the binder and the nature of the woodbase panel.

In the case of a formaldehyde-based binder for a fiberboard panel, the amount of binder for application to the wood fibers is between 3 to 20 wt %, preferably 5 to 15 wt %, especially preferably between 8 and 12 wt %. Where, conversely, polyurethane-containing binders, such as PMDI, are used for fiberboard panels, the required amount of binder is reduced to 1 to 10 wt %, preferably 2 to 8 wt %, especially preferably to 4 to 6 wt %.

In the case of chipboard panels, preference is given to using formaldehyde-based binders, with binder quantities between 5 and 8 wt %, preferably between 6 and 7 wt %, being used for the middle layer, and binder quantities between 6 and 10 wt %, preferably between 8 and 9 wt %, being used for the outer layer. Where a polyurethane-based binder, such as PMDI, is used in chipboard panels, the amount of binder in the middle layer is between 2 and 5 wt %, preferably 3 wt %, and the amount of binder in the outer layer is between 4 and 8 wt %, preferably 5 wt %.

As already indicated, in one embodiment of the present process, a polymer adhesive is used preferably as the binder, selected from the group containing formaldehyde adhesives, polyurethane adhesives, epoxy resin adhesives, and polyester adhesives; primarily, formaldehyde adhesives are employed.

As formaldehyde adhesive it is possible in particular to use a phenol-formaldehyde resin adhesive (PF), a cresol/resorcinol-formaldehyde resin adhesive, urea-formaldehyde resin adhesive (UF) and/or melamine-formaldehyde resin adhesive (MF).

Appropriate alternatives to the formaldehyde adhesive, to a lesser extent, are polyurethane adhesives based on aromatic polyisocyanates, especially polydiphenylmethane diisocyanate (PMDI), tolylene diisocyanate (TDI) and/or diphenylmethane diisocyanate (MDI), with PMDI being particularly preferred.

Also possible and conceivable would be the use of mixtures of two or more polymer adhesives, such as a formaldehyde adhesive (such as MUF, MF, UF) and a polyurethane adhesive (such as PMDI). Hybrid adhesive systems of this kind are known from EP 2 447 332 B1.

It is likewise possible to supply at least one flame retardant together with or separately from the binder to the wood shavings or wood fibers.

The flame retardant may be added to the wood fiber/binder mixture typically in an amount between 1 and 20 wt %, preferably between 5 and 15 wt %, especially preferably 10 wt %.

Typical flame retardants are selected from the group encompassing phosphates, borates, especially ammonium polyphosphate, tris(tribromoneopentyl) phosphate, zinc borate, or complexes of boric acid with polyhydric alcohols.

In a subsequent process step, the wood shavings or wood fibers are dried to a degree of moisture of 1% to 10%, preferably 3% to 5%. In the case of wood shavings, the drying operation takes place preferably in a single-stage operation, such as in a drum dryer, for example, whereas wood fibers may be dried in a two-stage operation.

The dried wood shavings or wood fibers are subsequently classified or sorted according to their size and are preferably put into interim storage, in silos or bunkers, for example.

The classifying of the shavings or fibers after the drying operation is typically associated with a secondary cleaning procedure. For this purpose, the fibers are placed into a stream of air and are very largely freed from heavy components such as resin lumps, either by swirling, abrupt deflections, impact classifying, ascending-air classifying, or by a combination of two or more effects. After that, the fibers are again separated from the stream of air, via cyclone separators, and are passed on for further use. In the case of the classifying of wood shavings, they are subdivided into coarser shavings for the middle layer and finer shavings for the outer layers.

As observed above, the resination of the wood fibers may take place even prior to drying. Alternatively, the wood fibers may also be resinated after drying. In the event of the use of wood shavings, however, resination takes place after classifying, with the resination being accomplished by mixing of shavings and resin.

After classifying has taken place, the resinated wood shavings or wood fibers are scattered onto a conveyor belt to form a shaving cake or fiber cake. The scattering station typically used in the case of wood fibers consists of a metering bunker, a mat scattering facility and a mat smoothing facility. In the case of wood shavings, it is usual to operate with pneumatic scattering, with scattering first of a first outer layer, followed by the middle layer, and lastly by a second outer layer.

The shaving cake or fiber cake is subsequently first subjected to preliminary pressing and thereafter is subjected to hot pressing at temperatures between 100° C. and 250° C., preferably 130° C. and 220° C., more particularly at 200° C.

In this case, the shaving cake or the fiber cake, after scattering has taken place, is first of all weighed and the moisture content is measured. The shaving or fiber cake subsequently enters the preliminary press. Here, the cake is reduced in thickness in the course of cold preliminary compaction, to allow the subsequent hot presses to be loaded more efficiently, with a reduction in the risk of damage to the cake. In the case of preliminary compaction in continuous operation, it is usual to operate with preliminary belt presses, on the principle of the conveyor belt (less often with preliminary plate belt presses, on the principle of the caterpillar track, or with preliminary roll belt presses, on the principle of the transport of pyramid stones with wooden logs).

Preliminary pressing is followed by the trimming of the compacted cake or the mat. Here, lateral strips are removed from the mat, thus allowing production of the panel width desired accordingly. The lateral strips are returned to the operation upstream of the scattering machine. Further measuring devices may follow, for monitoring density or detecting metal. Also possibly following is a mat spraying facility for improving the surface qualities or accelerating the heating of the mats right through.

This is followed by hot pressing, which may be carried out in cycles or continuously. In the present context, preference is given to hot pressing carried out continuously. This is done using continuous presses which operate with a press belt or with press plates via which the pressure and the temperature are transmitted. The belt in this case is supported either by a carpet of rollers, a carpet of rods or an oil cushion, relative to the hot plates, which are heated usually with thermal oil (less often with steam). This press system allows the production of panel thicknesses of between 1.5 mm and 60 mm. On calender presses, it is possible exclusively to produce thin chipboard or fiberboard panels. Pressing in this case takes place with press rolls and an outer belt on a heated calender roll.

After the hot-pressing procedure, the pressed panels are finished. Following that there are usually a series of measurements for quality control, particularly thickness control.

In one particularly preferred embodiment, the present process for producing a chipboard panel with reduced VOC emission comprises the following steps:

a1) producing wood chips from suitable lumbers,
b1) optionally preliminarily drying the wood chips,
c1) heat-treating at least a part of the wood chips at a temperature between 150° C. and 300° C. over a period of 1 h to 5 h,
d1) water-treating the heat-treated wood chips,
e1) flaking the non-heat-treated wood chips and at least a part of the heat-treated wood chips to form wood shavings;
f1) classifying the wood shavings;
g1) resinating the wood shavings produced from heat-treated wood chips or from a mixture of wood shavings produced from non-heat-treated wood chips and wood shavings produced from heat-treated wood chips, with at least one binder;
h1) scattering the resinated wood shavings onto a conveyor belt, to form a multilayer shaving cake, the wood shavings being scattered over one another as first outer layer, middle layer, and second outer layer;
i1) compressing the shaving cake to form a chipboard panel.

In one particularly preferred embodiment, the present process for producing a fiberboard panel with reduced VOC emission comprises the following steps:

a2) producing wood chips from suitable lumbers,
b2) optionally preliminarily drying the wood chips,
c2) heat-treating at least a part of the wood chips at a temperature between 150° C. and 300° C. over a period of 1 h to 5 h,
d2) water-treating the heat-treated wood chips,
e2) fiber-digesting the non-heat-treated wood chips and at least a part of the heat-treated wood chips to form wood fibers;
f2) mixing the wood fibers produced from heat-treated wood chips, or a mixture of wood fibers produced from non-heat-treated wood chips and wood fibers produced from heat-treated wood chips, with at least one binder;
g2) scattering the resinated wood fibers onto a conveyor belt, to form a single-layer fiber cake,
h2) subjecting the fiber cake to preliminary pressing, and
i2) hot-pressing the fiber cake to form a fiberboard panel.

The use of heat-treated wood chips for producing chipboard and fiberboard panels has a series of advantages. Hence it is particularly advantageous that the wood shavings and wood fibers produced from the heat-treated wood chips are particularly easy to dry, owing in particular to the low hydrophilicity of the heat-treated wood. This is also an advantage for the utilization of the fiberboard panels produced, since the wood shavings or wood fibers produced from the heat-treated wood chips possess a lower equilibrium moisture content than the non-heat-treated wood, at defined temperatures and atmospheric humidities.

A further positive aspect of the use of heat-treated wood chips as starting material is that the initial lumber raw material is made more uniform. This is of particular economic significance because, when using wood chips in order to produce chipboard or fiberboard panels or other woodbase materials, it is necessary to take account of the seasonal fluctuations in the raw lumber material. Another advantage is that heat-treated wood chips are not subject to biodegradation or other changes as a result of storage, thereby allowing the heat-treated wood chips to be stored over a relatively long time period. Furthermore, no constituents are leached out by water contact, since they have been destroyed in the heat-treatment operation.

Accordingly, the present process allows the production of a chipboard and fiberboard panel featuring reduced emission of volatile organic compounds (VOCs) and comprising in each case wood shavings or wood fibers produced from heat-treated wood chips. The present chipboard panel may consist entirely of wood shavings produced from heat-treated wood chips, or of a mixture of wood shavings produced from untreated (i.e., not heat-treated) wood chips and those produced from heat-treated wood chips.

Correspondingly, the present fiberboard panel may consist entirely of wood fibers produced from heat-treated wood chips, or of a mixture of wood fibers produced from untreated (i.e., not heat-treated) wood chips and wood fibers produced from heat-treated wood chips.

The present chipboard or fiberboard panel in each case has, in particular, a reduced emission of aldehydes released during the wood digestion procedure, especially pentanal, hexanal or octanal, and/or of organic acids, especially acetic acid.

The present woodbase panel in the form of a chipboard panel or fiberboard panel may have a panel density between 400 and 1200 kg/m$^3$, preferably between 500 and 1000 kg/m$^3$, especially preferably between 600 and 800 kg/m$^3$.

The thickness of the present woodbase panel in the form of chipboard panel or fiberboard panel may be between 3 and 20 mm, preferably between 5 and 15 mm, particular preference being given to a thickness of 10 mm.

The present chipboard panel consists of 60 to 90 wt %, preferably 70 to 80 wt %, of wood shavings and 5 to 20 wt %, preferably 10 to 15 wt %, of binders.

The present fiberboard panel consists of a fiber mixture comprising 60 to 90 wt %, preferably 70 to 80 wt %, of wood fibers and 5 to 20 wt %, preferably 10 to 15 wt %, of binders. In this regard, reference is made to the observations above regarding the nature of the binders used.

As stated above, both the present chipboard panel and the present fiberboard panel may consist of a mixture of wood shavings/wood fibers produced from non-heat-treated wood chips and wood shavings/wood fibers produced from heat-treated wood chips. The mixture used in the chipboard panel and in the fiberboard panel may comprise between 10 and 50 wt %, preferably between 20 and 30 wt %, of shavings/fibers produced from non-heat-treated wood chips, and between 50 and 90 wt %, preferably between 70 and 80 wt %, of shavings/fibers produced from heat-treated wood chips. As already elucidated above, in the case of the chipboard panel, the shavings obtained from the heat-treated wood chips are used preferably in the middle layer.

Both the present chipboard panel and the present fiberboard panel may be used as a low-emission chipboard or fiberboard panel for furniture and also for paneling for floor, wall or ceiling.

The problem of the present invention is likewise solved with the use of wood shavings or wood fibers produced from heat-treated wood chips.

Accordingly, wood shavings and wood fibers produced from heat-treated wood chips are used for reducing the emission of volatile organic compounds (VOCs) from chipboard or fiberboard panels.

In one preferred variant, the wood shavings and wood fibers produced from heat-treated wood chips are used for reducing aldehydes and/or organic acids released during the wood digestion procedure.

Correspondingly, the wood shavings/wood fibers produced from heat-treated wood chips are presently used preferably for reducing the emission of organic acids, more particularly for reducing the emission of acetic acid and hexanoic acid. Organic acids are obtained in particular as dissociation products of the wood constituents cellulose, hemicelluloses, and lignin, with preferential formation of alkanoic acids, such as acetic acid, propionic acid, hexanoic acid, or aromatic acids.

It is likewise desirable to use the wood shavings/wood fibers produced from heat-treated wood chips in order to reduce the emission of aldehydes. In this context it is especially preferred if the wood fibers are used for reducing aldehydes released during the aqueous wood digestion procedure. Correspondingly, the wood shavings or wood fibers produced from heat-treated wood chips are used for reducing the emission of C1-C10 aldehydes, especially preferably of pentanal, hexanal or octanal.

The invention is elucidated in more detail below with reference to the figures of the drawing, in terms of a number of working examples. In the drawing:

DESCRIPTION OF THE INVENTION

Figure 1:
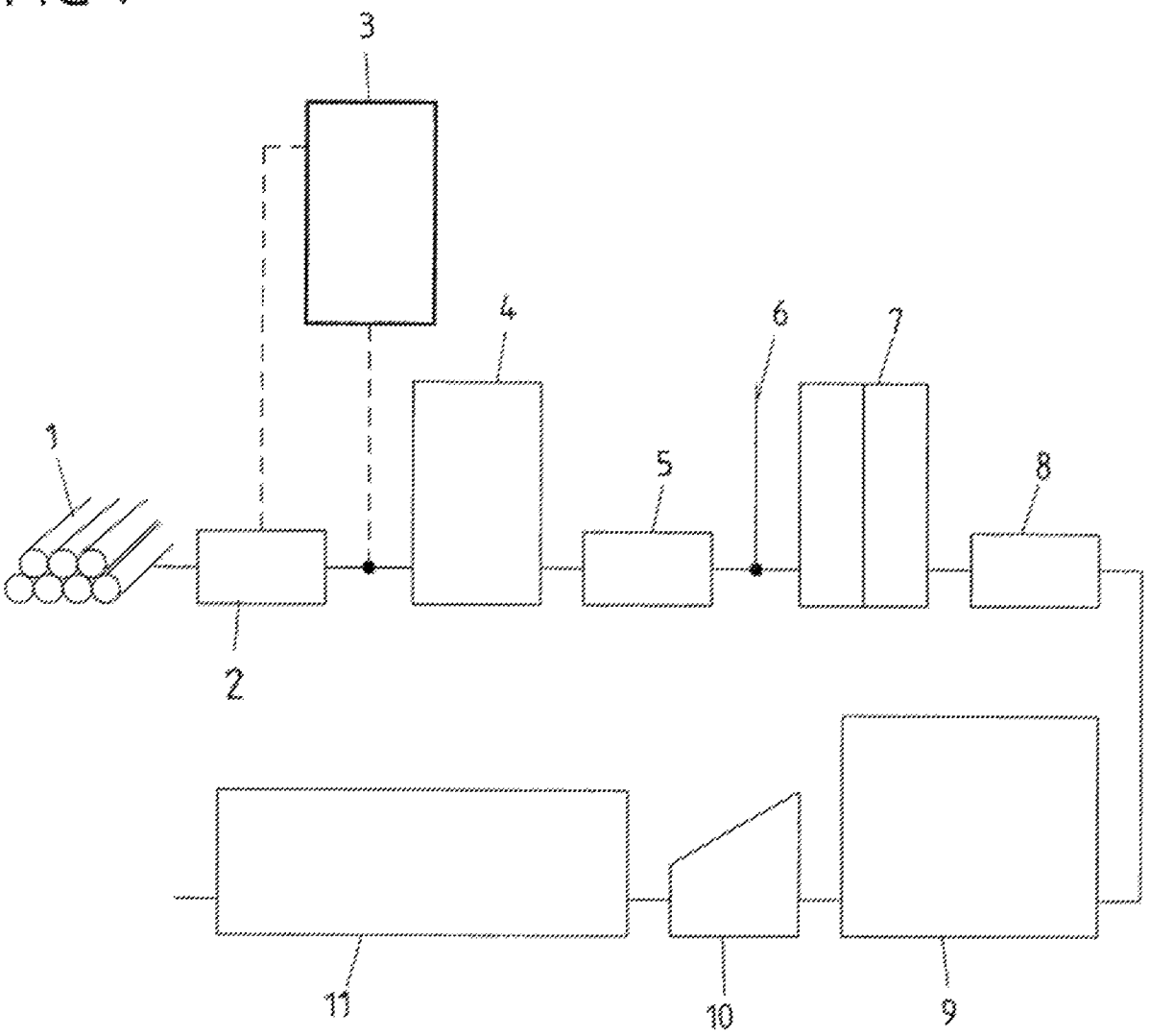
FIG. 1 shows a diagrammatic representation of a first embodiment of the process of the invention for producing a fiberboard panel.

The first embodiment of the process of the invention, shown in FIG. 1, describes the individual process steps, beginning with the provision of the lumber starting product, through to the final fiberboard panel.

First of all in step 1, accordingly, suitable lumber starting material is provided for producing the wood chips. Suitable lumber starting material includes all hardwoods, softwoods or else mixtures thereof. The roundwood is debarked and comminuted to chips in disk chippers or drum chippers (step 2), where the size of the wood chips can be controlled accordingly.

Following comminution and provision of the wood chips, they are optionally subjected to a preliminary drying operation, to adjust the moisture content to 5-10% in relation to the initial moisture content of the wood chips.

In the case of the first embodiment shown in FIG. 1, at least a part of the optionally preliminarily dried wood chips are removed from the customary production process and introduced into a heat-treatment reactor (step 3). The heat treatment of the removed wood chips takes place in a temperature range between 220° and 260° C. The pyrolysis gases formed in this procedure are utilized to generate the energy required for the operating plant.

After the end of the heat treatment, which in the present case lasts about 2 hours, the heat-treated wood chips are reintroduced into the process and are brought to a moisture content of 10-20% again in a washing and boiling step 4, optionally together with the non-heat-treated wood chips.

Thereafter, the wood fibers are subjected to the fiberizing operation in a refiner (step 5), and in the course of the fiberizing operation a suitable wetting agent is supplied to the wood fibers.

Immediately after fiber digestion, the wood fibers may be mixed with a liquid binder and optionally with a flame retardant (step 6). In this process stage, the contacting of the wood fibers with the liquid binder may take place, for example, in a blowline process.

The resinating step 6 is followed by a drying operation on the resinated wood fibers (step 7), and this drying operation may take place in two stages I, II. The dryer is configured as a 2-stage dryer, with the primary drying taking place in stage 1 by means of hot gases (air or superheated steam) and subsequent drying in stage 2, where again the use of hot air or superheated steam is possible. The mixture of substances is separated in/after each stage by means of separating cyclone and capsule mechanisms.

The dried wood fibers are sorted or classified according to their size (step 8).

The resinated wood fibers are subsequently scattered onto a conveyor belt (step 9), and the fiber cake formed is first supplied to a preliminary press (step 10) and lastly is pressed in the hot press (step 11) to form a large-format fiberboard panel.

In the final machining operation, the fiberboard panel obtained is finished in a suitable way.

Figure 2:
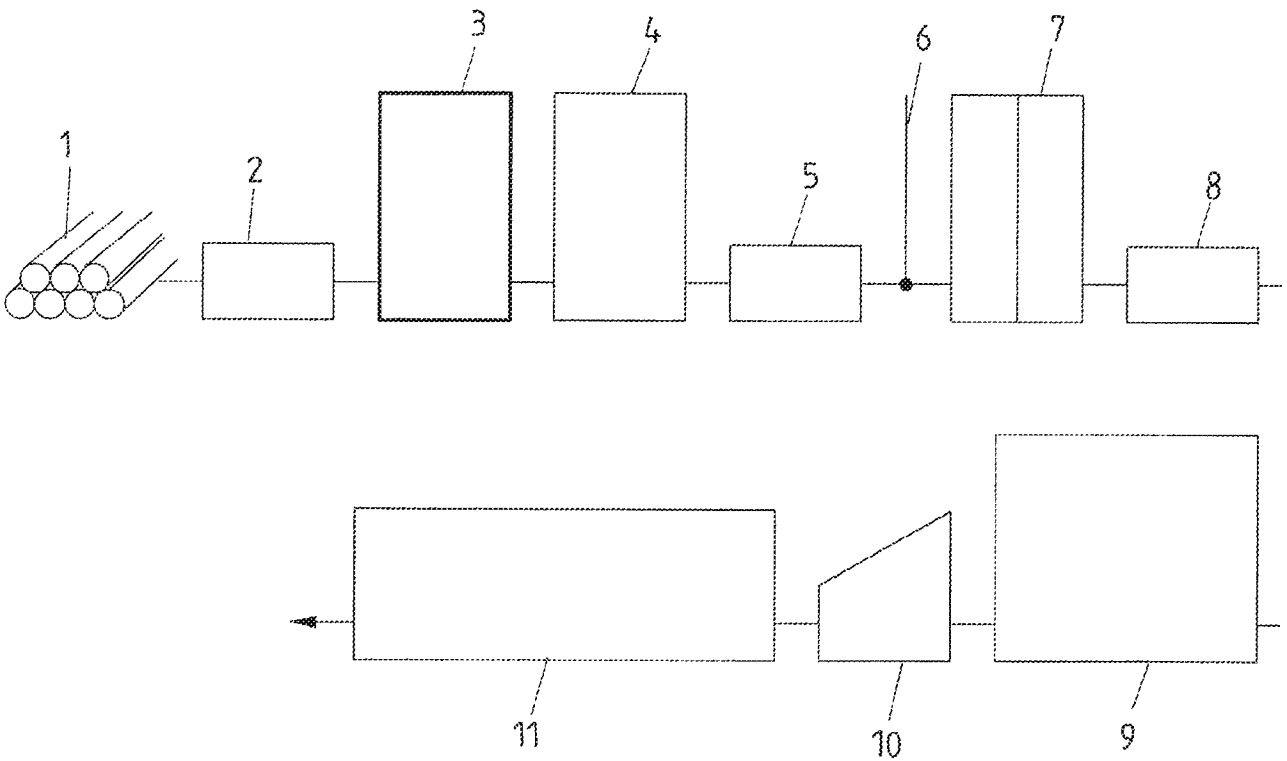
FIG. 2 shows a diagrammatic representation of a second embodiment of the process of the invention for producing a fiberboard panel.

The second working example, shown in FIG. 2, differs from the first embodiment depicted in FIG. 1 in that the step of heat-treating the wood chips (step 3) is integrated into the operation of producing the fiberboard panels, i.e., the heat-treatment step is incorporated into the overall operation or operating line and takes place on-line. Consequently there is no removal of the wood chips from the operating line for the heat treatment. This is advantageous especially if the fiberboard panel is produced entirely of wood fibers obtained from heat-treated wood chips.

Working Example 1: Fiberboard Panel, Especially MDF

Wood chips are kept in undried form (moisture content: around 50%, format: around 5×5 cm, thickness: around 1 cm) in a continuous heat-treatment apparatus at 220° C. under saturated steam for around 2 h. The apparatus consists of a conveying apparatus by which the chips are transported through slowly with the aid of a spiral conveyor.

The chips are subsequently cooled in the chip scrubber and are then supplied for standard fiberizing. In this case, 0.1% of a commercial surfactant was contained in the water of the chip scrubber. This surfactant was added in order to improve the wetting of the hydrophobic chips. The water in the scrubber showed a significantly reduced coloration, and the loading with organic constituents was reduced by around 90%.

The chips obtained after fiberizing were resinated with a standard commercial urea-formaldehyde resin in the blow-line and dried. Then the fibers were scattered and were processed to form an MDF having a density of 650 kg/m$^3$ and a thickness of 10 mm.

The resulting MDF is subsequently investigated together with a control sample (made from chips which have not been heat-treated) for VOC emissions in accordance with the AgBB scheme. For reasons of time, the 3-day value was ascertained.

Chamber parameters: temperature 23° C.; atmospheric humidity 50%+−5%; air exchange 0.5/h+−0.1/h; loading 1 m$^2$/m$^3$; chamber volume 225 m$^3$

| Parameter | Control sample µg/m$^3$ | Experimental panel µg/m$^3$ |
|---|---|---|
| Acetic acid | 188 | 9 |
| Hexanoic acid | 91 | n.d. |
| Hexanal | 51 | 4 |
| Pentanal | 43 | 9 |
| Octanal | 33 | 5 |

As from the table, the emissions of the quantitatively most important parameters from the experimental panel are at a significantly lower level.

Working Example 2: Chipboard Panel

The production of chipboard panels is general knowledge. The wood chips, heat-treated in the same way as for working example 1, are supplied to a flaking device. After flaking has taken place, the wood shavings are dried to a residual moisture content of around 2% in a drum dryer. After drying has taken place, the wood shavings are classified and separated into coarser shavings for the middle layer and finer shavings for the outer layer.

After having been resinated with urea-formaldehyde resin, the shavings are scattered to form multilayer shaving cakes, with the shavings used in the middle layer having been obtained from heat-treated wood chips, and the cakes are pressed to form panels at temperatures of around 200° C.

The emissions investigation, carried out in the same way as for working example 1, revealed similarly reduced VOC emission values for acetic acid and for the higher aldehydes.

The invention claimed is:

1. A wood chipboard panel with reduced emission of volatile organic compounds (VOCs) comprising wood shavings produced from heat-treated and non-heat-treated wood chips by shaving and gluing, wherein, in the case of heat treatment, the wood chips are exposed to a temperature between 150° C. and 300° C. for a period of 1 hour to 5 hours prior to shaving, the wood chipboard panel consists of a mixture of 10% to 50% by weight of shavings obtained from non-heat-treated wood chips and 50% to 90% by weight of shavings obtained from heat-treated wood chips, and the wood chipboard panel exhibits a reduced emission of aldehydes and/or of organic acids released during wood decomposition as compared to a wood chipboard made of wood chips obtained from non-heat-treated wood chips.

2. The wood chipboard panel according to claim 1, wherein the shavings obtained from the heat-treated wood chips are used in a middle layer of the wood chipboard panel.

3. The wood chipboard panel according to claim 1, further comprising a binder selected from the group consisting of formaldehyde adhesives, polyurethane adhesives, epoxy resin adhesives, and polyester adhesives.

4. The wood chipboard panel according to claim 3, wherein the polyurethane adhesive is based on aromatic polyisocyanates.

5. The wood chipboard panel according to claim 4, wherein the aromatic polyisocyanate is polydiphenylmethane diisocyanate (PMDI), tolylene diisocyanate (TDI), and/or diphenylmethane diisocyanate (MDI).

6. The wood chipboard panel according to 3, wherein, when a polyurethane adhesive is used, the amount of binder in a middle layer is between 2% and 5% by weight and in a top layer is between 4% and 8% by weight.

7. The wood chipboard panel according to claim 1, wherein the wood chipboard panel has a bulk density between 400 kg/m$^3$ and 1200 kg/m$^3$.

8. The wood chipboard panel according to claim 1, wherein the aldehydes comprise one or more of pentanal, hexanal, or octanal.

9. A method of using a chipboard panel according to claim 1 for furniture, wall, floor and ceiling coverings.

10. A wood fiberboard panel with reduced emission of volatile organic compounds (VOCs) comprising wood fibers produced and glued by defibration from heat-treated and non-heat-treated wood chips, wherein, in the case of heat treatment, the wood chips are exposed to a temperature between 150° C. and 300° C. for a period of 1 hour to 5 hours prior to defibration, the wood fiberboard panel consists of a mixture of 10% to 50% by weight of fibers obtained from non-heat-treated wood chips and 50% to 90% by weight of fibers obtained from heat-treated wood chips, and the wood fiberboard panel exhibits a reduced emission of aldehydes and/or of organic acids released during wood decomposition as compared to a wood fiberboard made of wood chips obtained from non-heat-treated wood chips.

11. The wood fiberboard panel according to claim 10, further comprising a binder selected from the group consisting of formaldehyde adhesives, polyurethane adhesives, epoxy resin adhesives, and polyester adhesives.

12. The wood fiberboard panel according to claim 11, wherein the polyurethane adhesive is based on aromatic polyisocyanates.

13. The wood fiberboard panel according to claim 12, wherein the aromatic polyisocyanate is polydiphenylmethane diisocyanate (PMDI), tolylene diisocyanate (TDI), and/or diphenylmethane diisocyanate (MDI).

14. The wood fiberboard panel according to claim 11, wherein, when a polyurethane adhesive is used, the quantity of the binder is 1% to 10% by weight.

15. The wood fiberboard panel according to claim 10, wherein the wood fiberboard panel has a bulk density between 400 $kg/m^3$ and 1200 $kg/m^3$.

16. The wood fiberboard panel according to claim 10, wherein the aldehydes comprise one or more of pentanal, hexanal, or octanal.

17. A method of using a wood fiberboard panel according to claim 10 for furniture, wall, floor and ceiling coverings.

* * * * *